US005913626A

United States Patent [19]

Ishida et al.

[11] Patent Number: 5,913,626

[45] Date of Patent: Jun. 22, 1999

[54] PRINTER HAVING NOISE NOISE REDUCTION STRUCTURE

[75] Inventors: Hiroshi Ishida; Shigeki Mizuno; Kenjiro Murakami; Toshikazu Kotaka; Tatsumi Tsuboki; Motoyuki Niimura; Norio Horaguchi; Yoshiaki Nakayama, all of Nagano, Japan

[73] Assignee: Seiko Epson Corporation, Tokyo, Japan

[21] Appl. No.: 08/600,415

[22] Filed: Feb. 13, 1996

Related U.S. Application Data

[63] Continuation of application No. 08/329,058, Oct. 4, 1994, abandoned.

[30] Foreign Application Priority Data

| | | | |
|---|---|---|---|
| Oct. 29, 1993 | [JP] | Japan | 5-294107 |
| Oct. 29, 1993 | [JP] | Japan | 5-294108 |
| Oct. 29, 1993 | [JP] | Japan | 5-294109 |

[51] Int. Cl.[6] ..... B41J 29/10; B41J 13/02

[52] U.S. Cl. ..... 400/625; 400/636; 400/636.3; 400/690

[58] Field of Search ..... 400/625, 636, 400/693, 689, 690, 636.3, 641

[56] References Cited

U.S. PATENT DOCUMENTS

| | | | |
|---|---|---|---|
| 4,268,021 | 5/1981 | Rutishauser et al. | 271/4 |
| 4,422,782 | 12/1983 | Lawter et al. | 400/56 |
| 4,562,444 | 12/1985 | Nagashim et al. | 346/76 |
| 4,632,380 | 12/1986 | Ono | 271/127 |
| 4,679,953 | 7/1987 | Sone et al. | 400/636 |
| 4,767,114 | 8/1988 | Nishimoto | 271/3 |
| 4,787,764 | 11/1988 | Ikeda et al. | 400/616.2 |
| 4,809,032 | 2/1989 | Nakatomi et al. | 355/3 |
| 4,854,757 | 8/1989 | Kikuchi | 400/625 |
| 4,943,173 | 7/1990 | Okazaki et al. | 400/689 |
| 4,995,747 | 2/1991 | Englehardt | 400/625 |
| 5,121,867 | 6/1992 | Aoyama et al. | 400/625 |
| 5,156,477 | 10/1992 | Hasegawa | 400/693 |
| 5,209,591 | 5/1993 | Mizutani et al. | 400/642 |
| 5,213,427 | 5/1993 | Groose et al. | 400/625 |
| 5,244,295 | 9/1993 | Terashima et al. | 400/639 |
| 5,320,042 | 6/1994 | Showopfiner | 101/416.1 |
| 5,362,163 | 11/1994 | Takano | 400/625 |
| 5,387,043 | 2/1995 | Fujioka et al. | 400/625 |

FOREIGN PATENT DOCUMENTS

| | | |
|---|---|---|
| 0 410 458 A2 | 1/1991 | European Pat. Off. . |
| 0454412 | 10/1991 | European Pat. Off. . |
| 0454412A2 | 10/1991 | European Pat. Off. . |
| 0 549 989 A2 | 7/1993 | European Pat. Off. . |
| A20549989 | 7/1993 | European Pat. Off. . |
| 3931190A1 | 3/1991 | Germany . |
| 39 43 238 | 6/1991 | Germany . |
| 2238973 | 9/1990 | Japan . |
| 353961 | 3/1991 | Japan . |
| 2213106 | 8/1989 | United Kingdom . |
| 2 220 888 | 1/1990 | United Kingdom . |
| A2220888 | 1/1990 | United Kingdom . |
| 0410458A2 | 1/1991 | United Kingdom . |

*Primary Examiner*—John Hilten

*Attorney, Agent, or Firm*—Sughrue, Mion, Zinn, Macpeak & Seas, PLLC

[57] ABSTRACT

A printer wherein a drive roller of a pair of sheet discharge rollers is made of rubber and a driven roller of the pair of sheet discharge rollers is made of synthetic resin; the leading end of a sheet is guided so as to be abutted against the drive roller earlier than the driven roller; the sheet that is in the course of being discharged is guided by a sheet discharge tray so as to come in slidable contact with an edge portion that is on a print head side of a sheet discharge opening. As a result, the printer can provide satisfactory printing conditions quickly with a simple structure and reduce noise leaking from the sheet discharge opening.

6 Claims, 5 Drawing Sheets

FIG. 4(b)
FIG. 4(a)
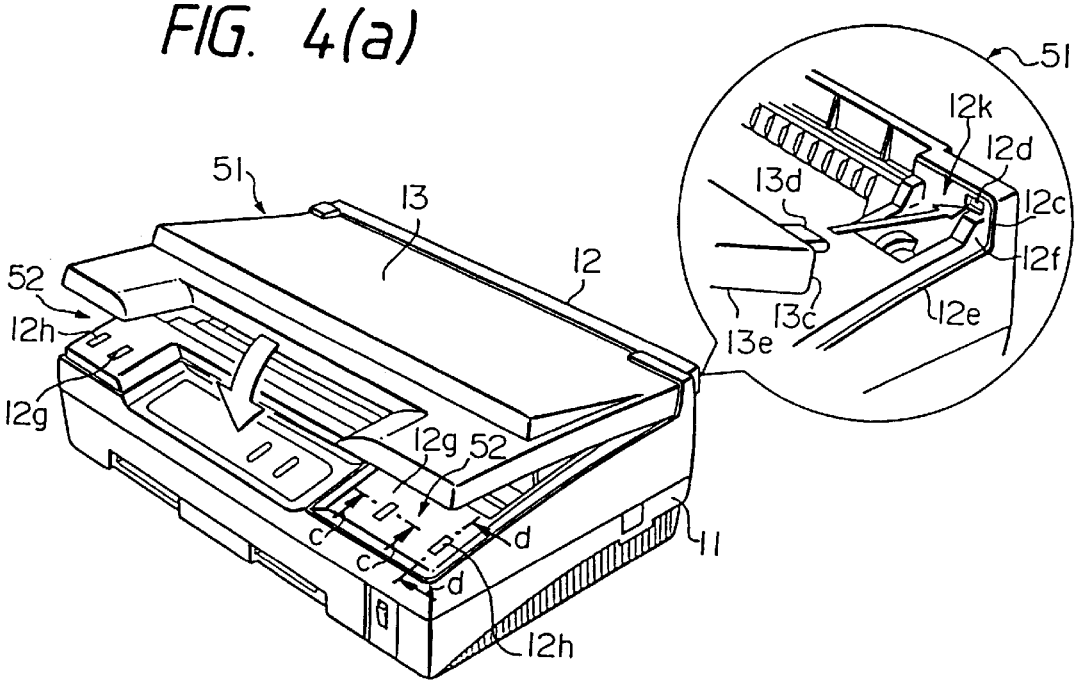
FIG. 4(c)
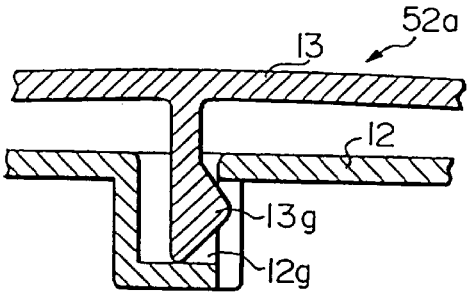
FIG. 4(d)
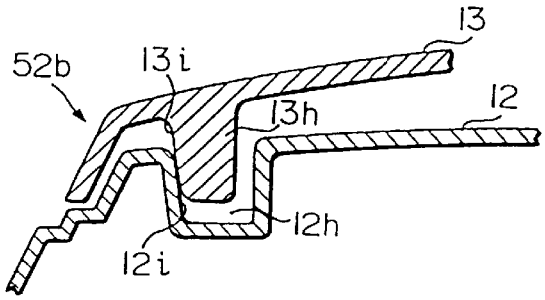

PRINTER HAVING NOISE NOISE REDUCTION STRUCTURE

This is a Continuation of application Ser. No. 08/329,058 filed Oct. 4, 1994, now abandoned.

BACKGROUND OF THE INVENTION

1. Field of the Invention

The invention pertains to printers. More particularly, the invention is directed to a printer that can not only provide satisfactory printing conditions as quickly as possible but also reduce noise by improving the sheet discharge structure. The invention is further directed to a printer that can provide stable sheet discharge operation with a simple structure for a type of printer in which one of a pair of sheet discharge rollers is mounted on the printer cover.

2. Related Art

FIG. 5 is a schematic side view showing a printer disclosed as related art in Japanese Unexamined Patent Publication No. 3-53961.

In FIG. 5 reference numeral 1 denotes a case of a printer. Within the case 1 are a platen 2 with a sheet P wrapped therearound, a print head H disposed so as to confront the platen 2, and a pair of sheet discharge rollers 3 that discharges the sheet P printed by the print head H.

The pair of sheet discharge rollers 3 include: a drive roller 3*a*, which is a first sheet discharge roller; and a driven roller 3*b*, which is a second sheet discharge roller.

The drive roller 3*a* is mounted on the case main body 1. The driven roller 3*b* is mounted on a cover 5.

The drive roller 3*a* receives motive power from the platen 2 and is driven at an increased circumferential speed with respect to the circumferential speed of the platen 2. The driven roller 3*b* rotates while abutted against the drive roller 3*a*.

The case 1 has a sheet discharge opening 4. The cover 5 is fixed so as to be turned around a shaft 5*b*.

According to the thus constructed printer, the sheet P wrapped around the platen 2 and printed by the print head H is forwarded by the pair of sheet discharge rollers 3 and discharged outside the case 1 from the sheet discharge opening 4.

Since the sheet discharge roller 3*b*, which is one of the pair of sheet discharge rollers 3, is mounted on the cover 5 that can be opened and closed, when the sheet P is jammed at the sheet discharge roller section, the jammed sheet can be removed with ease by opening the cover 5.

However, the above-mentioned printer has at least the following three problems.

Problem 1

In the above-mentioned printer generally the printing sound produced by the print head H is the major source of noise. Particularly, if the print head is of a wire dot type, the sound of the wire ends impacting the sheet aggravates the noise. On the platen 2 side, such noise is absorbed by the platen 2 itself, so the problem of this noise exists mainly on the print head H side.

In addition to the noise directly produced by the print head H, a noise caused by vibrations of the sheet itself that is vibrated by the print head H must also be taken care of.

In the above-mentioned conventional printer, there is a gap between the sheet P that is in the course of being discharged and an edge portion 4*a* on the print head H side of the sheet discharge opening 4. A noise leaking from this gap has been the problem.

To overcome this problem, printers have been disclosed in U.S. Pat. No. 4,943,173, and Japanese Unexamined Patent Publications Nos. 1-97674 and 60-17186. These printers are characterized as arranging a sound absorbing material at the sheet discharge opening and thereby causing a sheet to be abutted against the sound absorbing material.

However, such structure characterizing these printers requires additional sound absorbing members arranged at the sheet discharge opening of the printer case, which not only increases the number of parts but also makes the sheet discharge opening structure complicated.

On the other hand, a drawing in which a sheet is abutted against the edge portion of a case at the sheet discharge section is disclosed in Japanese Unexamined Patent Publication No. 2-14172.

However, this printer does not have a guide that allows the sheet to come in slidable contact with the edge portion of the case. As a result, it is not likely that the sheet will come in slidable contact with the edge portion of the case with a desired degree of certainty, thus not ensuring noise reduction.

Problem 2

To ensure satisfactory sheet discharge operation by the pair of sheet discharge rollers 3 in a printer such as shown in FIG. 5, it is preferable that both the drive roller 3*a* and the driven roller 3*b* be made of a material whose friction coefficient with respect to paper is larger, e.g., of rubber.

However, if the driven roller 3*b* is made of rubber to which ink is easy to adhere, the ink on a print surface Pa of the sheet P adheres to the driven roller. Then, the ink on the driven roller is further transferred to the print surface Pa of the sheet P, thereby contaminating the print surface, which is a problem.

This problem can be overcome by making the driven roller 3*b* of a material to which ink is hard to adhere, e.g., of synthetic resin.

However, if the driven roller 3*b* is made of synthetic resin, the friction coefficient of the synthetic resin with respect to paper is smaller than that of rubber, which imposes another problem.

That is, when the leading end of the sheet printed by the print head H is guided so as to be abutted against the driven roller made of synthetic resin, it takes time for the leading end of the sheet to be guided to the drive roller 3*a* and nipped between the pair of sheet discharge rollers 3 so as to have a forwarding force imparted thereto because the friction coefficient of the surface of the driven roller with respect to the sheet is small.

The sheet P is not wrapped around the platen 2 in contact with the platen 2, but floats up from the platen 2 surface until the forwarding force is given upon the leading end of the sheet having been nipped between the pair of sheet discharge rollers 3. As a result, satisfactory printing conditions are not always ensured. Particularly, if the print head is of the wire dot type, vibrations of the sheet caused by the wire ends colliding with the sheet are increased, which in turn causes noise.

Problem 3

Since the second sheet discharge roller (driven roller) 3*b* is disposed at a position remote from the cover 5 fixing section 5*b* of the cover 5 in a printer such as shown in FIG. 5, positioning accuracy of the second sheet discharge roller (driven roller) 3*b* to the first sheet discharge roller (drive roller) 3*a* is not satisfactory, thereby not ensuring stable sheet discharge operation, which is still another problem.

To overcome this problem, a structure characterized as arranging a member on the case main body side for positioning the shaft of the driven roller is disclosed in Japanese Unexamined Utility Model Publication No. 4-560.

However, this structure is problematical in that a positioning member other than the cover is required and this makes the structure complicated.

SUMMARY OF THE DISCLOSURE

A first object of the invention is to overcome the first problem and, therefore, to provide a printer that can reduce noise by minimizing noise leaking from the sheet discharge opening with a small number of parts and a simple structure.

A second object of the invention is to overcome the second problem and, therefore, to provide a printer that can prepare satisfactory printing conditions as quickly as possible and reduce noise.

A third object of the invention is to overcome the third problem and, therefore, to provide a printer that can ensure stable sheet discharge operation with a simple structure.

A printer of the invention includes: a print head disposed within a case; a sheet discharge opening, disposed in the case, for discharging a sheet printed by the print head; and a sheet discharge tray for guiding the sheet in the course of being discharged from the sheet discharge opening to an edge portion located on the print head side of the sheet discharge opening so as to come in slidable contact with the edge portion and supporting the sheet discharged from the sheet discharge opening. The sheet discharge opening is preferably arranged at an intersection between an upper surface and a back surface of the case.

Further, a printer of the invention includes: a platen for wrapping a sheet therearound; a print head disposed so as to confront the platen; a pair of sheet discharge rollers for discharging a sheet printed by the print head, one of the pair of sheet discharge rollers being made of a material whose friction coefficient with respect to the sheet is large and being disposed on a nonprinting side of the sheet, the other of the pair of sheet discharge rollers being made of a material to which an ink is hard to adhere and being disposed on a printing side of the sheet; and a sheet guide for guiding the sheet so that a leading end of the sheet abuts against said one of the pair of sheet discharge rollers earlier than said other of the pair of sheet discharge rollers. It is preferable that said one of the pair of sheet discharge rollers be a drive roller and that said other of the pair of sheet discharge rollers be a driven roller rotating while abutted against the drive roller. It is also preferable that the sheet guide be arranged inward with respect to the circumferential surface of the drive roller at the lateral sides of the drive roller.

Further, a printer of the invention includes: a case main body; a first sheet discharge roller mounted on the case main body; a cover fixed on the case main body so as to be opened and closed; a second sheet discharge roller, mounted on the cover, for discharging a sheet in cooperation with the first sheet discharge roller; and a cover fixing section, disposed close to the second discharge roller, for fixing the cover to the case main body.

Still further, a printer of the invention includes: a case main body; a first sheet discharge roller mounted on the case main body; a cover fixed on the case main body so as to be opened and closed; a second sheet discharge roller, mounted on the cover, for discharging a sheet in cooperation with the first sheet discharge roller. In such a printer, a cover fixing section for fixing the cover to the case main body is formed by a first fixing section and a second fixing section; the case main body in the first fixing section has a regulating section for regulating a position at which the cover is fixed; the second fixing section has a biasing section for biasing the cover onto the regulating section; and the first fixing section is disposed close to the second sheet discharge roller. It is preferable that the second sheet discharge roller be biased onto the first sheet discharge roller by a biasing means disposed between the second discharge roller and the cover.

BRIEF DESCRIPTION OF THE DRAWINGS

FIG. 4 (*a*) is a general perspective view of a structure in which a cover is going to be fixed to a case main body;

FIG. 4 (*b*) is a partially enlarged perspective view of FIG. 4 (*a*);

FIG. 4 (*c*) is a sectional view taken along a line c—c in (*a*);

FIG. 4 (*d*) is a sectional view taken along a line d—d in (*a*); and

DETAILED DESCRIPTION OF THE PREFERRED EMBODIMENT

An embodiment of the invention will now be described with reference to the drawings.

Figure 1:
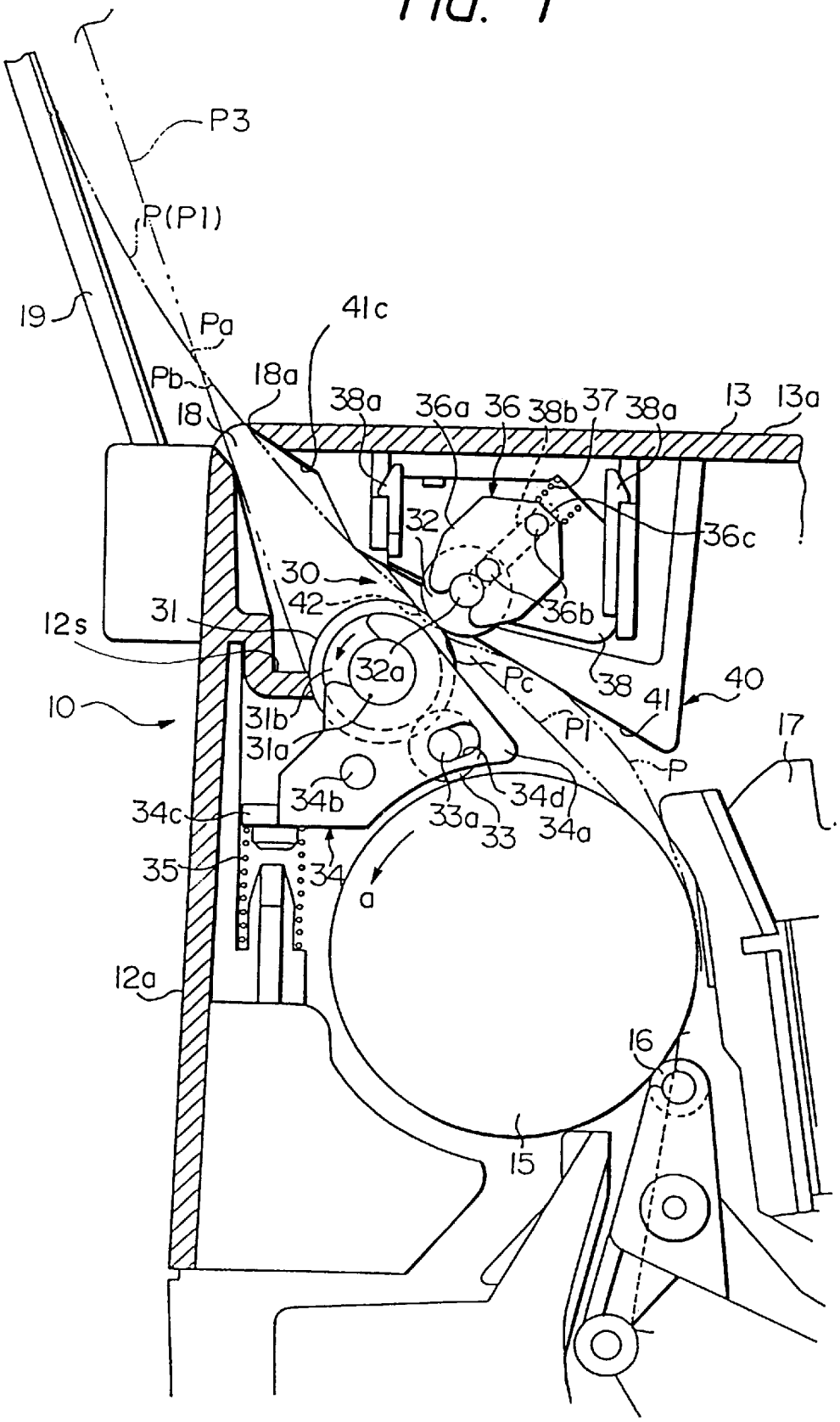
FIG. 1 is a segmentary side view of a printer, which is an embodiment of the invention.
Figure 2:
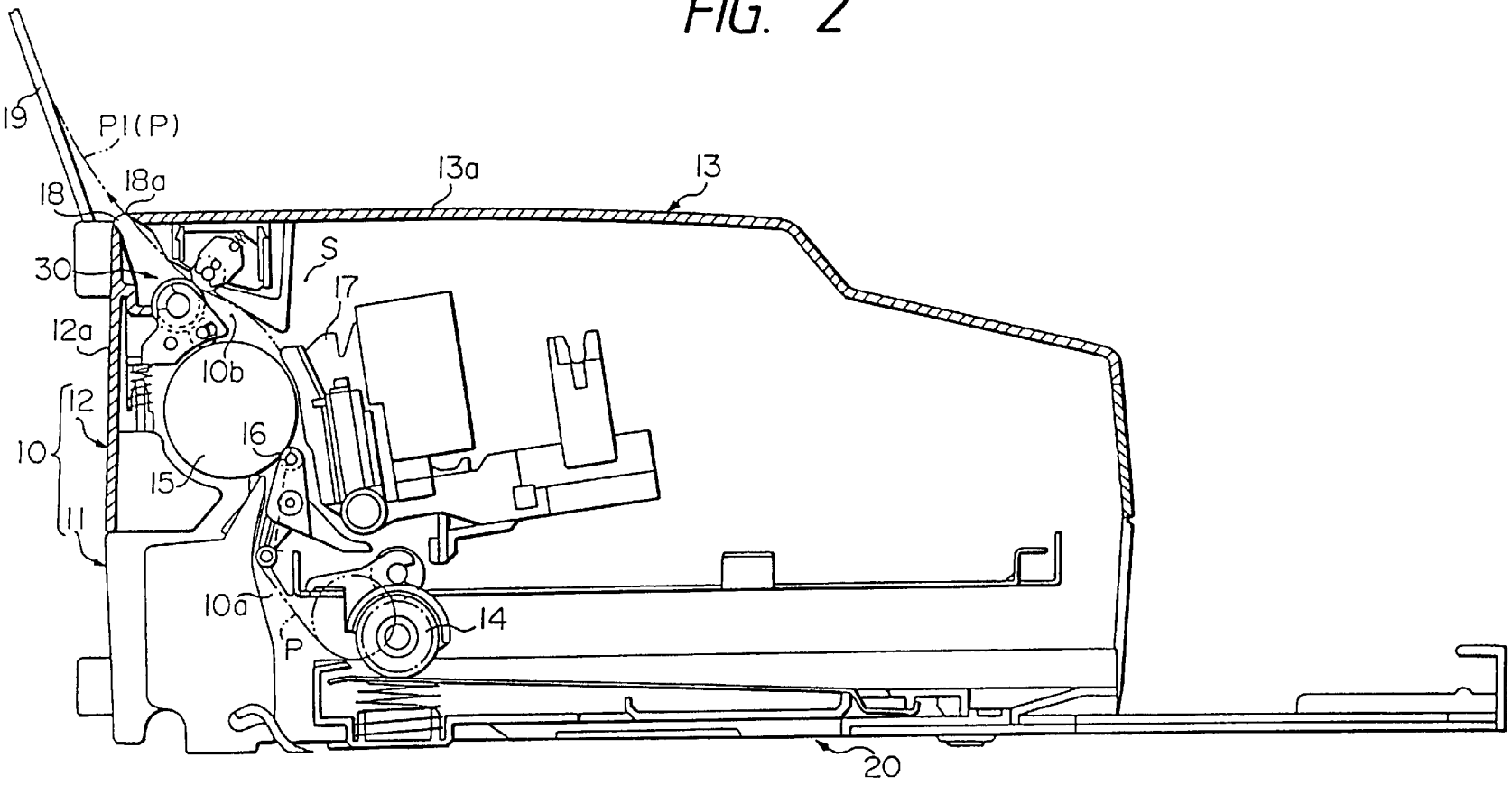
FIG. 2 is a diagram showing the internal structure of the embodiment shown in FIG. 1.
Figure 3:
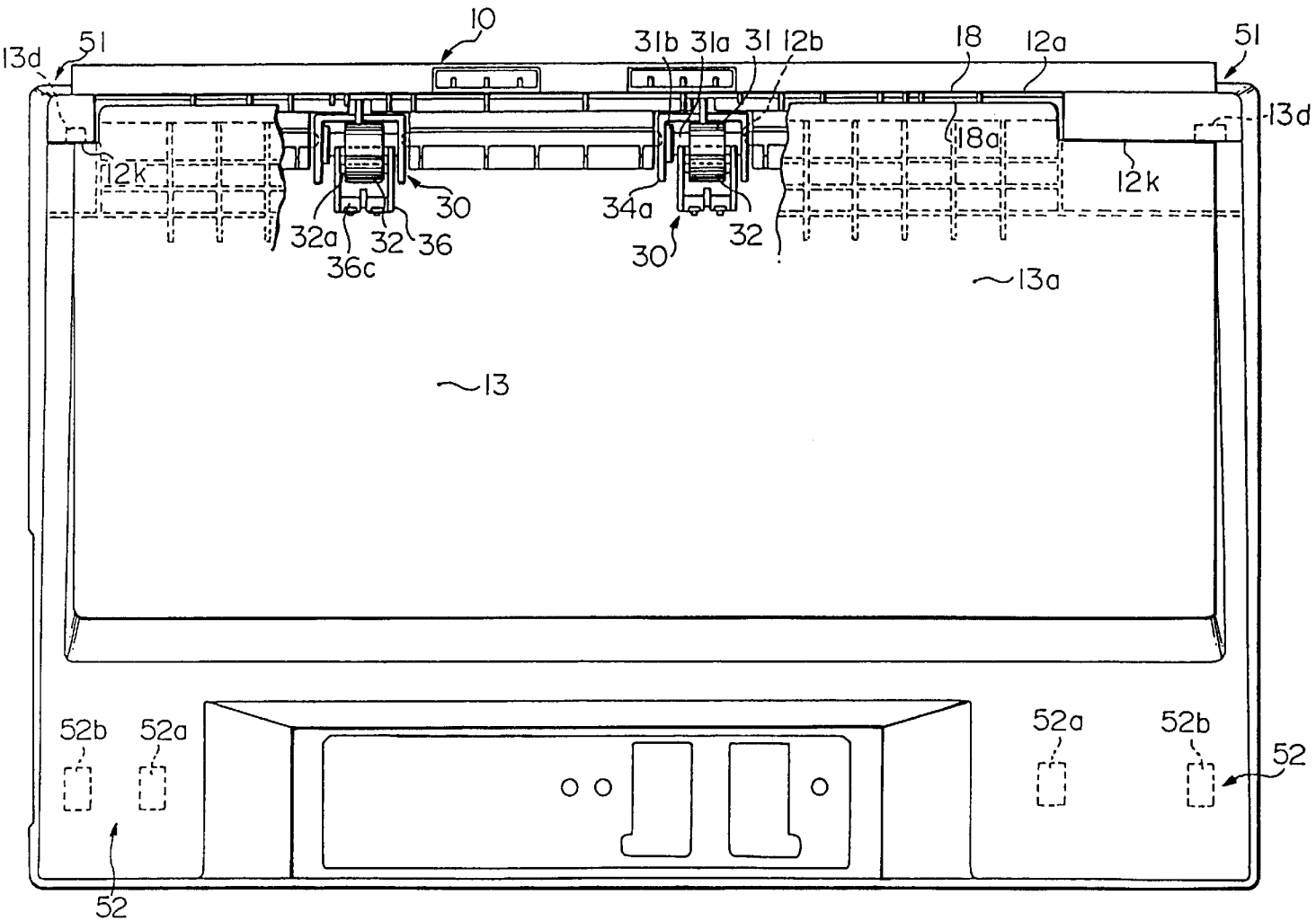
FIG. 3 is a schematic plan view of the embodiment shown in FIG. 1 with a part thereof omitted.

FIG. 1 is a segmentary side view of a printer, which is an embodiment of the invention; FIG. 2 is a diagram showing the internal structure of the printer as a whole; FIG. 3 is a plan view of the printer with a part thereof omitted; and FIG. 4 is a diagram illustrating the structure for fixing a cover to a case main body.

In FIG. 2 reference numeral 10 denotes a case main body of the printer. The case main body 10 includes a lower case 11 and an upper case 12.

Reference numeral 13 denotes a cover, which is fixed to the upper case 12 so as to be opened and closed. The case main body 10 and the cover 13 are made of synthetic resin.

Reference numeral 20 denotes a sheet feed cassette attached to the bottom of the case main body 10.

Reference numeral 14 denotes a sheet feed roller, which feeds sheets P (not shown in FIG. 2) placed in the sheet feed cassette 20 on a single sheet basis.

The fed sheet P is not only wrapped around a platen 15 via a sheet feed path 10*a* but also further fed while nipped between a sheet feed roller 16 and the platen 15 and printed through an ink ribbon (not shown) by a print head 17 of a wire dot type.

The printed sheet is discharged to a sheet discharge tray 19 from a sheet discharge opening 18 via a sheet discharge path 10*b* and a pair of sheet discharge rollers 30. As shown by a three-dot chain line in FIG. 1, a discharged sheet P3 is piled up in the sheet discharge tray 19 with the trailing end thereof supported by a support section 12*s* formed on the inner surface of the upper case.

As shown in FIG. 2, the sheet discharge opening 18 is arranged in the form of a slit (see FIG. 3) that extends in the sheet width direction at an intersection between an upper surface 13*a* of the cover and a back surface 12*a* of the upper case. An edge portion 18*a* located on the print head 17 side is linear.

The sheet discharge tray 19 constitutes a sheet guide. The sheet discharge tray 19 guides a sheet P1 that is in the course of being discharged so as to come in slidable contact with the edge portion 18*a* on the print head side of the sheet discharge opening 18.

As shown in FIG. 1, the pair of sheet discharge rollers 30 include a first sheet discharge roller 31 mounted on the case main body 10 side and a second sheet discharge roller 32 mounted on the cover 13 for discharging the sheet in cooperation with the first sheet discharge roller 31. In this embodiment the first sheet discharge roller 31 is a drive roller, and the second sheet discharge roller 32 is a driven roller that rotates while abutted against the drive roller.

The drive roller 31 is made of a material whose friction coefficient with respect to the sheet P is large, e.g., of rubber, and disposed on the side of a nonprinting surface Pb of the sheet P.

As shown in FIG. 3, this drive roller 31 has a gear 31*b* on one end of a shaft 31*a* and is driven with the gear 31*b* meshed with an intermediate gear 33 that rotates while abutted against the platen 15. The shaft 31*a* and the gear 31*b* of the drive roller 31 are made of synthetic resin. The drive roller is formed by firmly fixing a cylindrical body made of rubber to the shaft 31*a*.

Reference numeral 34 denotes a holder that is C-shaped when viewed from top. The holder 34 supports the shaft 31*a* of the drive roller 31 and a shaft 33*a* of the intermediate gear 33 rotatably. The holder 34 is pivotably supported by fitting holes 34*b*, 34*b* with projections 12*b*, 12*b*, the holes 34*b*, 34*b* being arranged on lateral plates 34*a*, 34*a* of the holder 34 and the projections 12*b*, 12*b* being disposed on the upper case 12. A compression spring 35 disposed between a bottom plate 34*c* of the holder 34 and the upper case urges the intermediate gear 33 in such a direction as to be abutted against the platen 15 at all times.

The intermediate gear 33 operates as a one-way clutch with the shaft 33*a* thereof being supported by a long hole 34*d* formed on the holder 34. The intermediate gear 33 transmits motive power to the drive roller 31 only when the platen 15 rotates in a direction indicated by the arrow a in FIG. 1. Therefore, the drive roller 31 does not rotate reversely, and the trailing end of the once discharged sheet P3 will no longer be nipped back into the pair of sheet discharge rollers 30.

The driven roller 32 is made of a material to which ink is hard to adhere, e.g., of synthetic resin, and is disposed on the side of the printing surface Pa of the sheet P.

A shaft 32*a* of the driven roller 32 is rotatably supported by a holder 36 that is C-shaped when viewed from top. The holder 36 is movable in and out with respect to the drive roller 31 with projections 36*b*, 36*b* slidably fitted into a long hole 38*b* of a support plate 38, the projections 36*b*, 36*b* being respectively disposed on lateral plates thereof 36*a*, 36*a* and the support plate 38 being attached to the cover 13 with engaging pawls 38*a*, 38*a*. A compression spring 37 serving as an urging means disposed between an upper plate 36*c* of the holder 36 and the cover 13 urges the driven roller 32 in such a direction as to be abutted against the drive roller 31 at all times.

As shown in FIG. 3, two pairs of sheet discharge rollers 30 are arranged in the sheet width direction.

Reference numeral 40 denotes a guide piece disposed integrally on the lower surface of the cover 13. A guide surface 41 has such an angle as to guide the sheet P that has been sent from the platen 15 while slightly bent so that the leading end Pc of the sheet P will be abutted against the drive roller 31 earlier than the driven roller 32.

A portion 42 of the guide piece 40 that is on a lateral side of the drive roller 31 is located inward with respect to the circumferential surface of the drive roller (i.e., toward the shaft 31*a*).

Further, the guide surface 41 of the guide piece 40 is not only designed to guide the sheet so that the leading end of the sheet does not touch the support plate 38 and the like, but also formed into a recess 41*c* in the vicinity of the sheet discharge opening 18 so that the slidable contact of the edge portion 18*a* with the sheet will not be disturbed.

As shown in FIGS. 3 and 4, the section at which the cover 13 having the above-mentioned driven roller 32 and guide piece 40 is fixed to the case main body 10 includes a first fixing section 51 and a second fixing section 52. A pair of first fixing sections 51 are disposed at a position close to the driven rollers 32, i.e., in the rear of the printer. A pair of second fixing sections 52 are disposed in the front of the printer.

In each first fixing section 51, a regulating section 12*k* that regulates the cover 13 fixing position is formed on the upper case 12.

The regulating section 12*k* has a regulating surface 12*c* and an opening 12*d*. The regulating surface 12*c* is substantially L-shaped when viewed from the front and is abutted against an end 13*c* of the rear end corner of the cover 13. The opening 12*d* receives therein an engaging piece 13*d* that projects rearward at a position slightly inward from the lateral surface of the rear end corner of the cover 13. Reference character 12*e* denotes a guide surface continuing from the regulating surface 12*c*; and 12*f*, a guide surface continuing from the regulating surface 12*c* and the guide surface 12*e*. These guide surfaces 12*e*, 12*f* are designed to guide the lower surface 13*e* and inner surface of the lateral plate of the cover 13.

Each second fixing section 52 has an engaging section 52*a* as shown in FIG. 4 (*c*) and a biasing section 52*b* shown in FIG. 4 (*d*).

The engaging section 52*a* includes an elastic pawl 13*g* formed integrally with the lower surface of the cover 13 and an engaging hole 12*g* formed on the upper case 12, so that when the cover 13 is attached to the upper case 12, the elastic pawl 13*g* clicks the engaging hole 12*g*.

The biasing section 52*b* includes: a recess 12*h* formed on the upper surface of the upper case 12; and a slightly bent projection 13*h* formed integrally on the lower surface of the cover 13. When the cover 13 is attached to the upper case 12, a front surface 13*i* of the projection 13*h* gets abutted against the inner surface 12*i* that is on the front side of the recess 12*h* strongly as the projection 13*h* enters the recess 12*h*. This force biases the cover 13 toward the above-mentioned regulating section 12*k*.

With respect to the engaging sections 52*a* and the biasing sections 52*b*, only those on the right side are shown in the drawing in enlarged form. It goes without saying that those on the left side are formed similarly (so as to be symmetrical) (see FIG. 3).

The following steps will be taken to attach the thus constructed cover 13 to the case main body 10. First, as shown in FIG. 4 (*b*), the engaging pieces 13*d* on the rear end of the cover are inserted into the openings 12*d* of the upper case 12. Then, as shown in FIG. 4 (*a*), the cover 13 is turned downward. As a result, the elastic pawls 13*g* of the cover 13 get fitted into the engaging holes 12*g* of the upper case 12; the projections 13*h* of the cover 13 enter into the recesses 12*h* of the upper case 12; and the cover 13 is attached and, at the same time, fixed to the upper case 12 while biased toward the regulating sections 12*k*. With the cover fixed in this way, the rear end corner of the cover 13 gets abutted against the regulating section 12*k* so strongly that positioning accuracy of the cover 13 with respect to the case main body 10 (the upper case 12) in the first fixing section 51 becomes quite high.

According to the thus constructed printer, the following advantages can be obtained.

Figure 5:
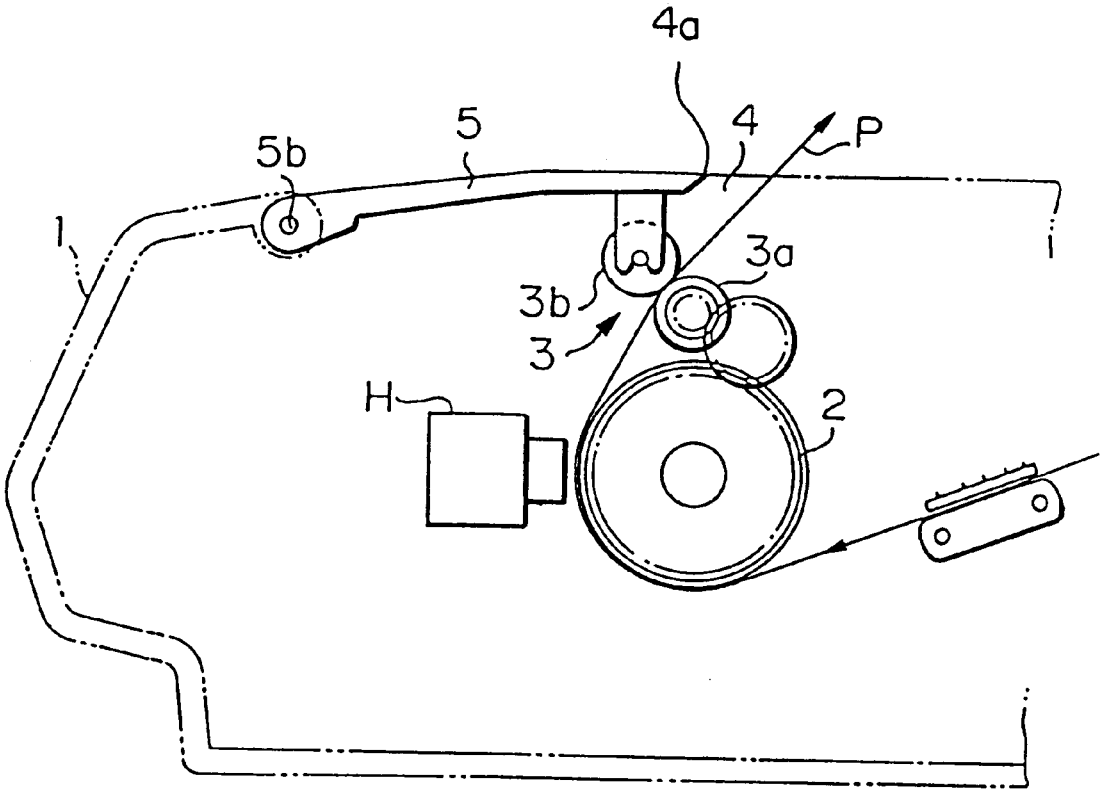
FIG. 5 PRIOR ART
FIG. 5 is a diagram illustrative of a conventional example.

(i) Since the sheet P1 that is in the course of being discharged is guided by the sheet discharge tray 19 so as to come in slidable contact with the edge portion 18*a* on the print head side of the sheet discharge opening 18, the gap between the sheet and the edge portion on the print head side of the sheet discharge opening, which is present in the case of the printer shown in FIG. 5, is closed by the sheet. In other words, a space S (see FIG. 2) into which a noise is scattered by the head 17 is closed by the upper case 12, the cover 13, and the sheet P1 that is in the course of being discharged.

At the same time, since the sheet P1 that is in the course of being discharged is guided by the sheet discharge tray 19 so as to come in slidable contact with the edge portion 18*a* on the print head side of the sheet discharge opening 18, vibrations of the sheet are disturbed at the portion of the sheet which is in slidable contact with the edge portion 18*a*, which in turn changes the mode of vibration to decay the vibration of the sheet itself.

Therefore, the amount of the noise produced by the head 17 leaking outside the case can be reduced remarkably.

In addition, since the structure in which the sheet is caused to come in slidable contact with the edge portion 18*a* of the sheet discharge opening 18 by the sheet discharge tray 19 that supports the discharged sheet P1 is adopted, no other sheet guides and sound absorbing members are required. Hence, the above-mentioned advantage can be obtained by a simple structure with the sheet discharge tray supporting the discharged sheet P1.

(ii) Since the sheet discharge opening 18 is disposed at an intersection between the upper surface 13*a* and the back surface 12*a* of the case, the noise produced by the print head is sent to the rear side of the printer. Therefore, the noise in the front of the printer where the user usually stays can be reduced more effectively together with the advantage (i).

(iii) Since the drive roller 31 is made of rubber and is disposed on the nonprinting surface Pb side of the sheet P and the driven roller 32 is made of synthetic resin and is disposed on the printing surface Pa side of the sheet P, not only satisfactory sheet P forwarding conditions can be ensured, but also the ink that has adhered to the printing surface Pa of the sheet will not be transferred onto the printing surface Pa again through the driven roller 32 any more.

(iv) Since the leading end Pc of the sheet is guided by the guide surface 41 of the sheet guide 40 so as to be abutted against the drive roller 31 earlier than the driven roller 32 and the drive roller 31 is made of rubber, the leading end Pc of the sheet can be guided and nipped into the pair of sheet discharge rollers 30 quickly.

Therefore, the force for forwarding the sheet P after printing can be given quickly, and the sheet P can be wrapped around the platen 15 quickly while in intimate contact therewith. The state in which the sheet P is wrapped around the platen in intimate contact is indicated by a two-dot chain line P1 in FIG. 1.

Hence, according to this printer, conditions for satisfactory printing by the head 17 can be prepared quickly.

Further, as a result of the sheet P having been wrapped around the platen 15 in intimate contact therewith quickly, vibrations of the sheet caused by the wires projected from the head 17 colliding against the sheet P can be reduced quickly.

(v) Since the portion 42 positioned on the lateral side of the drive roller 31 in the sheet guide 40 is disposed inward with respect to the circumferential surface of the drive roller 31, the sheet P can be guided so as to be biased onto the drive roller 31, so that further satisfactory sheet forwarding conditions can be ensured.

(vi) Since the section for fixing the cover 13 to the case main body 10 includes the first and second fixing sections 51, 52, stable conditions for fixing the cover 13 to the case main body 10 can be ensured.

(vii) The upper case 12 in the first fixing section 51 has the regulating sections 12*k* for regulating the cover 13 fixing position and the second fixing section 52 has the biasing sections 52*b* for biasing the cover 13 toward the regulating sections 12*k*. Therefore, when the case main body 10 and the cover 13 are fixed together by the first and second fixing sections 51, 52, positioning accuracy of the case main body 10 and the cover 13 in the first fixing section 51 becomes improved. Since the first fixing section 51 is disposed close to the driven roller 32, positioning accuracy of the drive roller 31 and the driven roller 32 can in turn be improved.

As a result, positioning accuracy of the driven roller 32 with respect to the drive roller 31 can be improved without requiring any other positioning member than the cover 13, which in turn ensures stable sheet discharge operation.

(viii) High positioning accuracy of the driven roller 32 with respect to the drive roller 31 can be obtained despite the fact that the driven roller 32 is mounted on the cover 13 as described above. As a result, inconsistencies in contact pressure of the compression spring 37 with respect to the drive roller 31 are reduced, thereby ensuring stable sheet discharge operation.

If the driven roller 32 were positioned with respect to the drive roller 31 with low accuracy, then the contact pressure by the compression spring 37 would become inconsistent, thereby not ensuring stable sheet discharge operation.

On the other hand, according to the printer, which is the embodiment of the invention, high positioning accuracy can be obtained despite the fact that the driven roller 32 is mounted on the cover 13 as described above. Therefore, inconsistencies in the contact pressure of the compression spring 37 can be reduced, thereby ensuring stable sheet discharge operation.

That is, the fixing structure of this type is particularly effective when the second sheet discharge roller disposed on the cover is urged toward the first sheet discharge roller by an urging means disposed between the second sheet discharge roller and the cover.

(ix) Since the cover 13 is fixed stably with respect to the upper case 12 and the edge portion 18*a* of the sheet discharge opening 18 is formed at the edge portion of the cover located close to the first fixing section 51 whose positioning accuracy is high as described above, the sheet P comes in slidable contact with the edge portion 18*a* stably, which in turn contributes to further stable noise reduction.

(x) Since the cover 13 is fixed stably with respect to the upper case 12 and the guide piece 40 is formed close to the first fixing section 51 whose positioning accuracy is high as described above, the leading end Pc of the sheet can be guided toward the pair of sheet discharge rollers 30 certainly as well as stably, which in turn contributes to further stable noise reduction.

The embodiment of the invention has been described above. However, the invention is not limited to the above-mentioned embodiment, but may be modified as appropriate within the scope and spirit of the invention.

For example, while first and second fixing sections have been described in the above embodiment, the number of fixing sections may be only one as long as the fixing section is disposed close to the second sheet discharge roller in order to obtain the above-mentioned advantages.

What is claimed is:

1. A printer comprising:

a case having a sheet discharge opening therein for discharging a sheet, the sheet discharge opening being defined by edge portions of the case;

a print head disposed within said case for printing on the sheet; and a sheet discharge tray for guiding the sheet in the course of being discharged from the sheet discharge opening, and for supporting the sheet after the sheet is discharged from the sheet discharge opening, wherein said sheet discharge tray is disposed so that the sheet slidably contacts at least one of the edge portions of the sheet discharge opening on a print head side of the sheet discharge opening as the sheet is discharged through said sheet discharge opening to provide a closed space at least partially defined by said case and the sheet, whereby said closed spaced reduces the amount of noise escaping from said printer.

2. A printer according to claim 1, wherein the edge portions are edge portions of an upper surface and a back surface of the case, respectively, and wherein said at least one of the edge portions slidably contacted by the sheet is the edge portion of the upper surface of the case.

3. A printer comprising:

a case main body;

a platen supported within said case main body;

a first sheet discharge roller mounted on the case main body, said first sheet discharge roller receiving a sheet delivered from said platen;

a cover fixed on the case main body so as to be opened and closed;

a second sheet discharge roller, mounted on the cover, for discharging the sheet in cooperation with the first sheet discharge roller;

a cover fixing section for fixing the cover to the case main body, the cover fixing section comprising a first fixing section and a second fixing section;

a regulating section associated with the first fixing section for regulating a fixing position of the cover; and a biasing section associated with the second fixing section for biasing the cover toward the regulating section, wherein the first fixing section is disposed in close proximity to the second sheet discharge roller.

4. A printer according to claim 3, wherein the second sheet discharge roller is biased toward the first sheet discharge roller by a biasing means disposed between the second discharge roller and the cover.

5. A printer according to claim 3, wherein said first fixing section comprises an engaging piece on said cover, said engaging piece being received in an opening formed in the case main body, and wherein said regulating section comprises a regulating surface for regulating a position of said cover.

6. A printer according to claim 3, wherein said second fixing section comprises an elastic pawl on said cover, said elastic pawl being received in an engaging hole formed in the case main body, and wherein said biasing section comprises a projection provided on said cover, said projection abutting an inclined inner surface of a recess formed in the case main body to bias said cover towards said regulating section.

* * * * *